US009207635B2

(12) United States Patent
Okamoto

(10) Patent No.: US 9,207,635 B2
(45) Date of Patent: Dec. 8, 2015

(54) IMAGE FORMING APPARATUS

(71) Applicant: Brother Kogyo Kabushiki Kaisha, Nagoya (JP)

(72) Inventor: Yoshihiro Okamoto, Kasugai (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/496,155

(22) Filed: Sep. 25, 2014

(65) Prior Publication Data

US 2015/0093141 A1 Apr. 2, 2015

(30) Foreign Application Priority Data

Sep. 27, 2013 (JP) ..... 2013-201654

(51) Int. Cl.
*G03G 21/20* (2006.01)

(52) U.S. Cl.
CPC ..... *G03G 21/206* (2013.01)

(58) Field of Classification Search
USPC ..... 399/92–94
See application file for complete search history.

(56) References Cited

U.S. PATENT DOCUMENTS

| | | | | |
|---|---|---|---|---|
| 2009/0152803 | A1* | 6/2009 | Matsumoto | 271/162 |
| 2012/0039625 | A1* | 2/2012 | Sekido et al. | 399/110 |
| 2013/0136485 | A1* | 5/2013 | Takahashi | 399/92 |

FOREIGN PATENT DOCUMENTS

| | | | |
|---|---|---|---|
| JP | 2005-070459 | A | 3/2005 |
| JP | 2009-244672 | A | 10/2009 |
| JP | 2011-107511 | A | 6/2011 |
| JP | 2013-210423 | | 10/2013 |

* cited by examiner

*Primary Examiner* — Minh Phan
(74) *Attorney, Agent, or Firm* — Burr & Brown, PLLC

(57) ABSTRACT

An image forming apparatus, comprising: a housing having an opening through which a recording medium passes, the housing comprising a container unit configured to support at least a part of the recording medium passed through the opening; a feed roller configured to feed the recording medium supported in the container unit to an image formation unit; and a fan configured to cause air in the housing to flow, wherein the container unit comprises: a stacker part to support at least the part of the recording medium; and a pair of side parts disposed to sandwich the stacker part between the pair of side parts, in an orthogonal direction perpendicular to a feeding direction of the feed roller, and the fan is disposed at one of the pair of side parts and at a position closer to the opening relative to the feed roller in the feeding direction.

10 Claims, 5 Drawing Sheets

IMAGE FORMING APPARATUS

CROSS-REFERENCE TO RELATED APPLICATION

This application claims priority under 35 U.S.C. §119 from Japanese Patent Application No. 2013-201654, filed on Sep. 27, 2013. The entire subject matter of the application is incorporated herein by reference.

BACKGROUND

1. Technical Field

Aspects of the present invention relate to an electrophotographic type image forming apparatus.

2. Related Art

Conventionally, image forming apparatuses comprising a box-shaped main body, an image formation unit provided in the main body and a fan have been proposed. For example, one of such image forming apparatuses further comprises therein a duct through which a flowing path of air is formed. In this example, the duct is fixed to a left surface of a left frame of the main body, and the fan is supported by the duct such that the fan is disposed to have an interval, on the left side, with respect to the left frame. In this configuration, air in the duct is discharged leftward.

SUMMARY

Recently, a demand for enhancing a degree of freedom regarding an installation space for an image forming apparatus is increasing. However, when the image forming apparatus of the above described type is placed to adjoin an installed object, such as a wall, on the right side of the installed object, the fan is also disposed to adjoin the installed object on the right side of the installed object. In this case, air discharge by the fan may be hampered. As a result, flowing of air in the duct is restricted, and thereby heat cannot be radiated adequately.

Aspects of the present invention are advantageous in that an image forming apparatus capable of causing air in a housing to smoothly flow even when the image forming apparatus is placed next to an installed object.

According to an aspect of the invention, there is provided an image forming apparatus, comprising: a housing having an opening through which a recording medium passes, the housing comprising a container unit configured to support at least a part of the recording medium passed through the opening; a feed roller configured to feed the recording medium supported in the container unit to an image formation unit; and a fan configured to cause air in the housing to flow. The container unit comprises: a stacker part configured to support at least the part of the recording medium; and a pair of side parts disposed to sandwich the stacker part between the pair of side parts, in an orthogonal direction which is perpendicular to a feeding direction of the feed roller. The fan is disposed at one of the pair of side parts and at a position closer to the opening relative to the feed roller in the feeding direction.

BRIEF DESCRIPTION OF THE ACCOMPANYING DRAWINGS

DETAILED DESCRIPTION

Hereafter, an embodiment according to the invention will be described with reference to the accompanying drawings.

1. Overall Configuration of Printer

Figure 1:
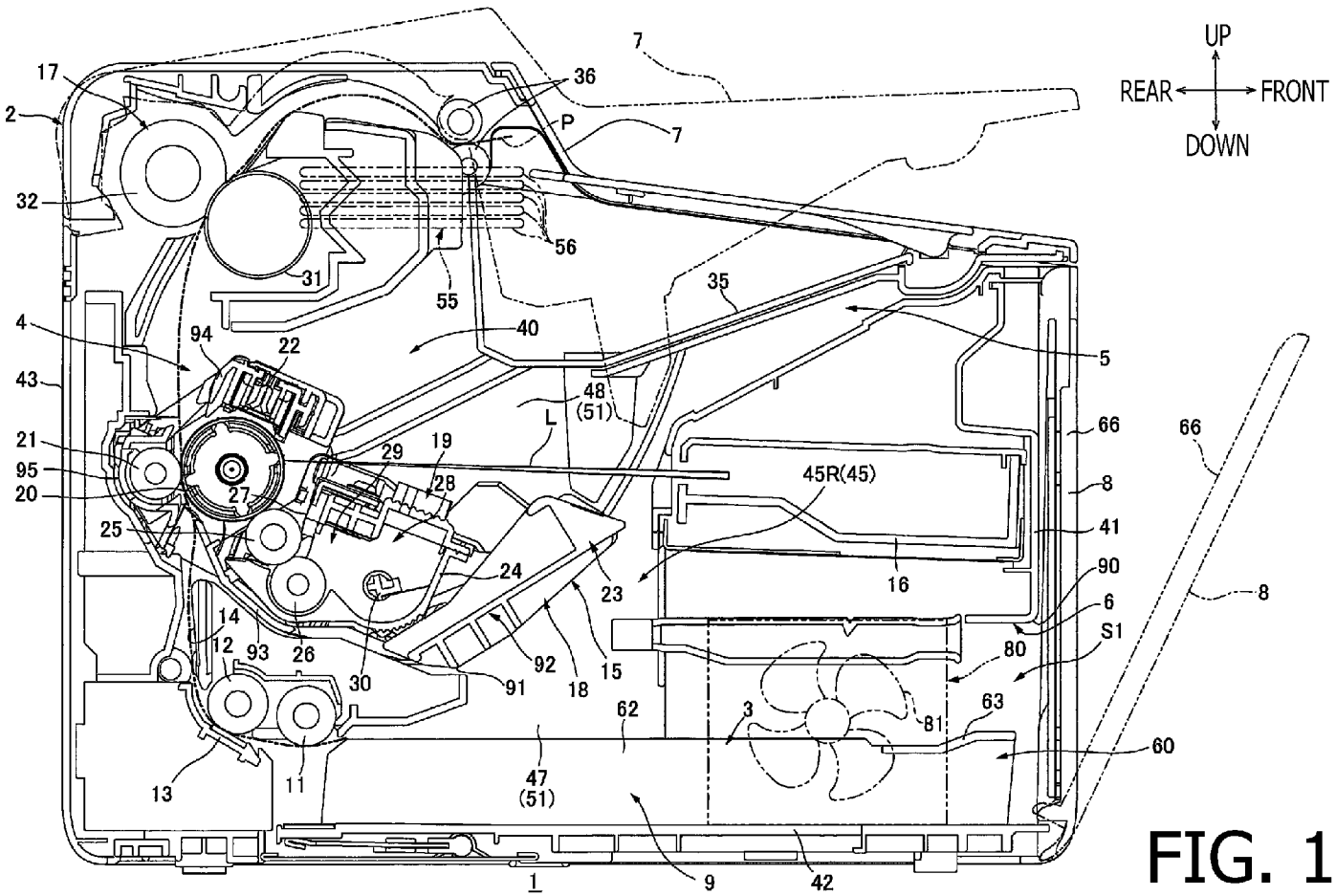
FIG. 1 is a central cross section of a printer according to an embodiment, illustrating a situation where a paper supply cover is at a closed position.

As shown in FIG. 1, a printer 1 (an example of an image forming apparatus) includes a body casing 2. The body casing 2 is formed in a box shape, and accommodates therein a paper supply unit 3 configured to supply a sheet of paper P (an example of a recording medium), and an image formation unit 4 configured to form an image on the supplied sheet of paper P.

Figure 4:
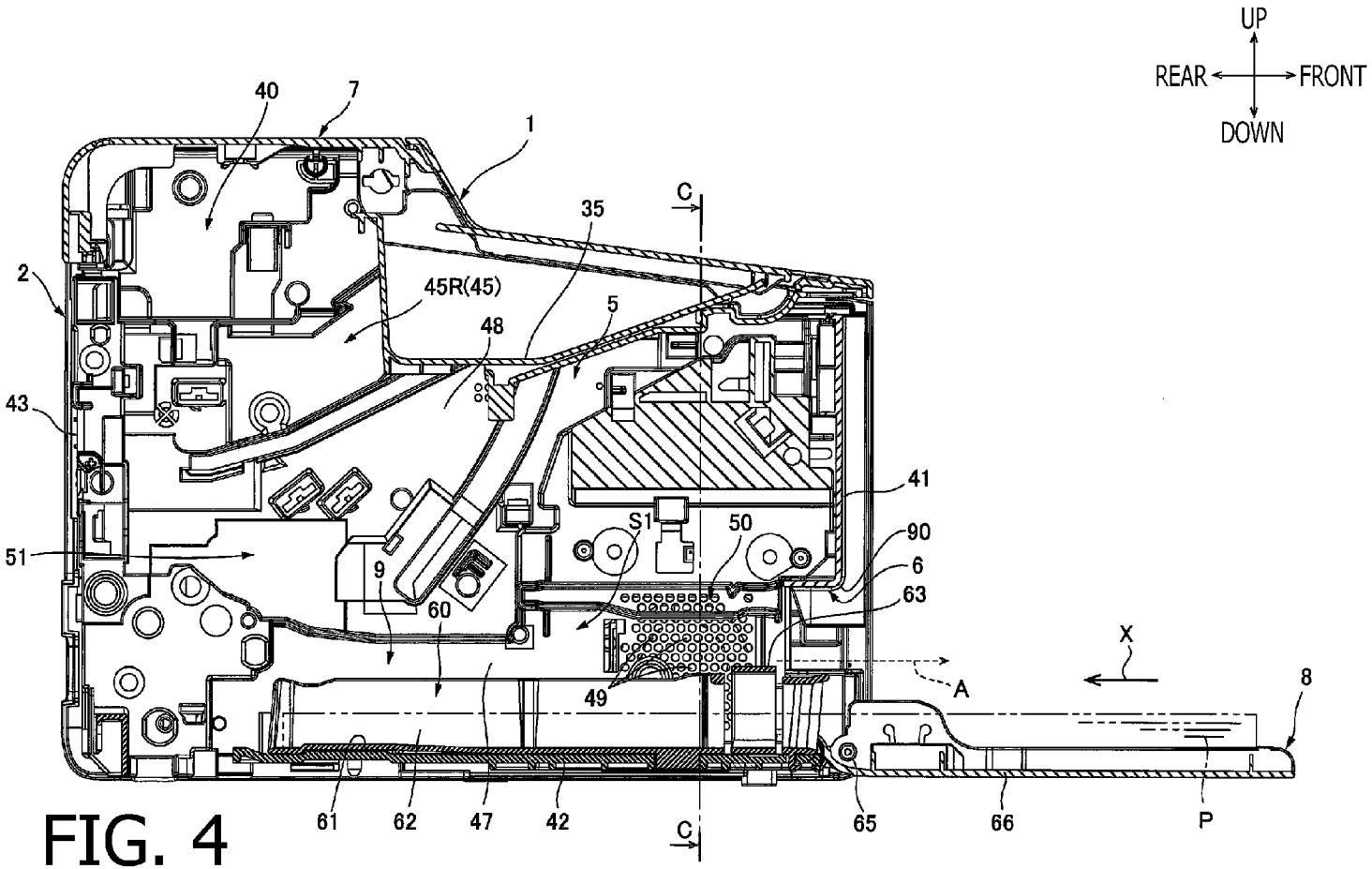
FIG. 4 is a central cross section of the printer shown in FIG. 2, illustrating a situation where the paper supply cover is at the opened position.

In the following explanation, when a direction is referred to, the right side on the paper face of FIG. 1 is defined as the front side, and the left side on the paper face of FIG. 1 is defined as the rear side with respect to a state where the printer 1 is placed horizontally. The left and right direction is defined with reference to a state where the printer 1 is viewed from the front side, and the forehand side of the paper face of FIG. 1 is the left side and the back side of the paper face of FIG. 1 is the right side. The upper side in the paper face of FIG. 1 is the upper side, and the lower side in the paper face of FIG. 1 is the lower side. That is, each of the left and right direction and the front and rear direction is a horizontal direction, and the up and down direction is the vertical direction. Further, as shown in FIG. 4, a direction pointing to the rear side from the front side is a feeding direction X.

(1) Body Casing

As shown in FIG. 1, the body casing 2 includes a cartridge opening 5 and a paper opening 6. The cartridge opening 5 is disposed at the upper edge part of the body casing 2, and lets the inside and the outside of the body casing 2 communicate with each other. The cartridge opening 5 is formed to have a size and a shape for letting a process cartridge 15 (which is described later) pass therethrough.

The paper opening 6 is disposed at the front edge part of the body casing 2 to penetrate through a lower part of the front edge part of the body casing 2 in the front and rear direction. Further, as shown in FIG. 1, the body casing 2 includes a top cover 7 and a paper supply cover 8. The top cover 7 is disposed at the upper edge part of the body casing 2 so as to cover the cartridge opening 5 from the upper side. The top cover 7 is formed in a shape of a crank when viewed as a side view, and is formed in a rectangular shape when viewed as a plan view.

The top cover 7 includes a paper discharge tray 35. The paper discharge tray 35 is formed to be a recessed part of which front part is recessed downward, and is opened toward the upper side. When viewed as a side view, the top cover 7 is formed in a shape of a letter U.

The top cover 7 is configured to swing about the rear edge part between a closed position where the cartridge opening 5 is closed and an opened position where the cartridge opening 5 is opened. In FIG. 1, the top cover 7 disposed at the closed position is indicated by a slid line, and the top cover 7 disposed at a position between the closed position and the opened position is indicated by a virtual line.

Figure 2:
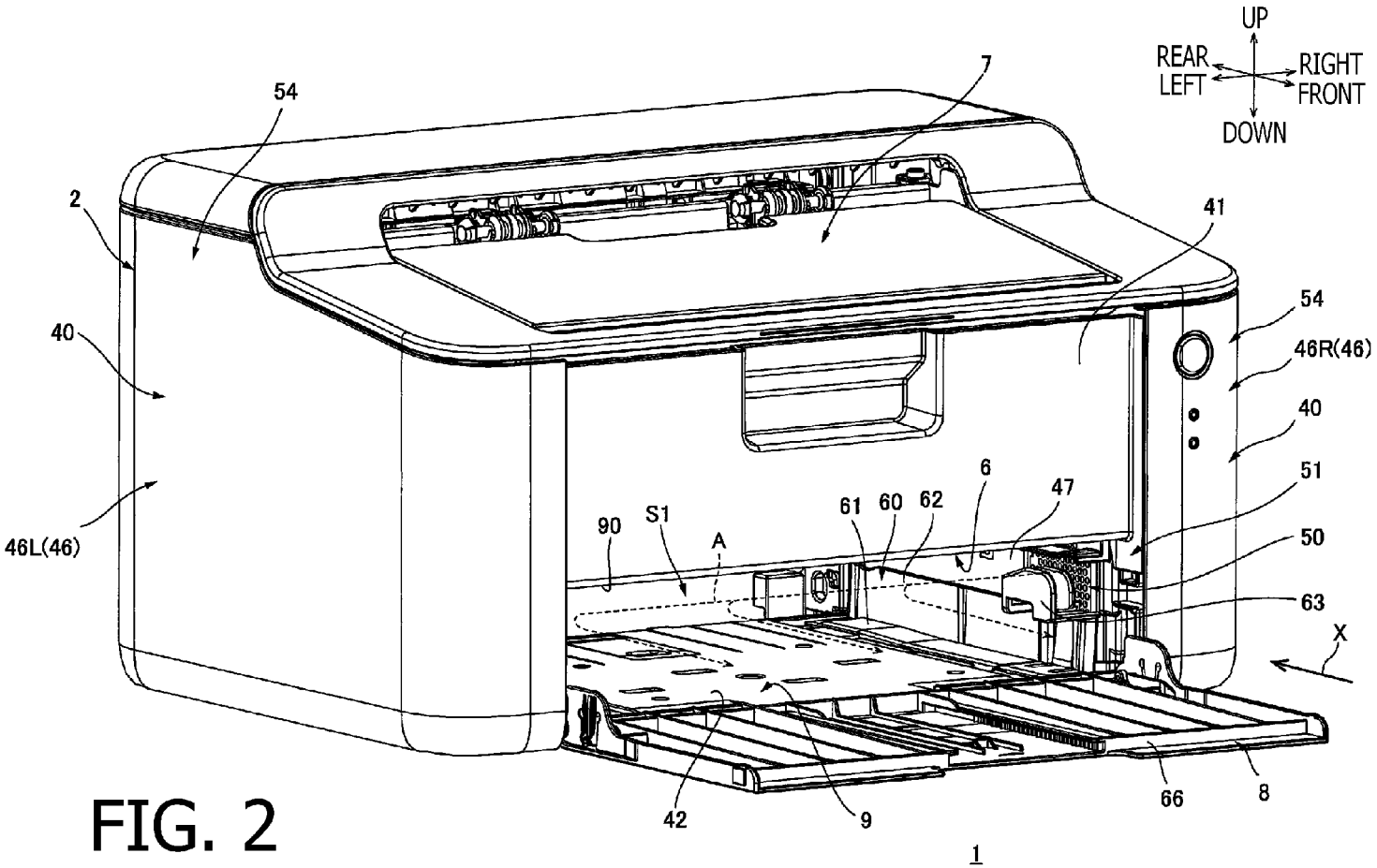
FIG. 2 is a perspective view of the printer shown in FIG. 1 viewed from a front left side and illustrates a situation where the paper supply cover is at an opened position.

The paper supply cover 8 is disposed in the front edge part of the body casing 2 to cover the paper opening 6 from the front side. The paper supply cover 8 is swingable about a lower end thereof between a closed position where the paper opening 6 is closed and an opened position where the paper opening 6 is opened as shown in FIG. 2. In FIG. 1, the paper supply cover 8 at the closed position is indicated by a solid line, and the paper supply cover 8 at a position between the closed position and the opened position is indicated by a virtual line.

(2) Paper Supply Unit

The paper supply unit 3 is configured to supply the sheet of paper 3 to the image formation unit 4, and is disposed in a bottom portion of the body casing 2. The paper supply unit 3 includes a paper container 9, a pickup roller 11, a paper supply roller 12, a paper supply pad 13 and a paper supply path 14. As described in detail later, the paper container 9 is configured to define a paper container space S1 in which the rear part of the sheet of paper P is supported. The paper container space S1 communicates with the outside of the body casing 2 in the front and rear direction via the paper opening 6. It should be noted that a feeding direction of the paper supply roller 12 is defined as the feeding direction X.

The pickup roller 11 is disposed on the upper rear side of the paper container 9 to face the upper rear edge of the paper container space S1. The paper supply roller 12 is disposed on the rear side of the pickup roller 11 to have an interval therebetween. Further, the paper supply roller 12 is disposed at a position lower than an upper edge 90 of the paper opening 6. That is, when viewed along the front and rear direction, the paper supply roller 12 is disposed to overlap with the paper opening 6. The paper supply pad 13 is disposed on the lower side of the paper supply roller 12 to contact the lower rear edge of the paper supply roller 12. The paper supply path 14 is provided to extend continuously from the rear edge of the paper supply pad 13.

(3) Image Formation Unit

The image formation unit 4 includes the process cartridge 15, a scanner unit 16 and a fixing unit 17. The process cartridge 15 is configured to form a toner image on the sheet of paper P, and to be detachably attachable to the body casing 2. The process cartridge 15 includes a drum cartridge 18 and a development cartridge 19. The drum cartridge 18 includes a drum frame 23, a photosensitive drum 20, a transfer roller 21 and a scorotron charger 22.

The drum frame 23 is formed in a rectangular frame shape having a bottom. The drum frame 23 includes a pair of drum side walls (not shown), a drum front wall 92, a drum bottom wall 93, a charge support wall 94, and a roller container wall 95. The pair of drum side walls (not shown) are provided to face with each other to have an interval therebetween in the left and right direction.

The drum front wall 92 is provided to extend between front edge parts of the pair of drum side walls (not shown). The drum bottom wall 93 is provided to extend between lower edge parts of the pair of drum side walls (not shown). Further, the front edge part of the drum bottom wall 93 is connected to the lower edge part of the drum front wall 92.

The charge support wall 94 is provided to extend between upper rear edge parts of the pair of drum side walls (not shown). The charge support wall 94 has a shape of a square cylinder extending in the left and right direction. The roller container wall 95 is provided to extend between lower rear edge parts of the pair of drum side walls (not shown). Further, the roller container wall 95 is disposed on the lower rear side with respect to the charge support wall 94 to have an interval therebetween, and is disposed on the upper rear side with respect to the drum bottom wall 93 to have an interval therebetween. The charge support wall 94 is formed in a shape of a letter U which is opened toward the front side when viewed as a side view.

The photosensitive drum 20 is formed in a cylindrical shape extending in the left and right direction, and is rotatably supported in a rear portion of the drum frame 23.

The transfer roller 21 is formed in a cylindrical shape extending in the left and right direction, and is disposed on the rear side of the photosensitive drum 20 in the roller container wall 95. The front edge part of the transfer roller 21 contacts the rear edge part of the photosensitive drum 20. Further, the transfer roller 21 is rotatably supported by the drum frame 23.

The scorotron charger 22 is disposed on the upper front side of the photosensitive drum 20 to have an interval therebetween, and is supported by the charge support wall 94. The development cartridge 19 is configured to be detachably attachable to the drum frame 23, and is disposed on the lower front side of the photosensitive drum 20 in a state where the development cartridge 19 is attached to the drum frame 23.

The development cartridge 19 includes a development frame 24, an agitator 30, a development roller 25, a supply roller 26 and a layer thickness limiting blade 27.

The development frame 24 is formed in a box-shape extending in the left and right direction, and the rear edge part of the development frame 24 is opened in the front and rear direction. Further, the development frame 24 includes therein a toner reservoir 28 and a development chamber 29 which are arranged in the front and rear direction. The toner reservoir 28 stores toner which is an example of a developer.

The agitator 30 is disposed in a central portion in the up and down direction and in the front and rear direction in the toner reservoir 28. Further, the agitator 30 is rotatably supported by the development frame 24.

The development roller 25 is disposed in the rear edge portion of the development chamber 29. The development roller 25 is formed in a cylindrical shape extending in the left and right direction, and is rotatably supported by the development frame 24. Further, the upper part and the rear part of the development roller 25 are exposed from the development frame 24, and the upper rear edge part of the development roller 25 contacts the lower front edge part of the photosensitive drum 20.

The supply roller 26 is disposed on the lower front side of the development roller 25 in the development chamber 29. The supply roller 26 is formed in a cylindrical shape extending in the left and right direction, and is rotatably supported by the development frame 24. The upper rear edge part of the supply roller 26 contacts the lower front edge part of the development roller 25.

The layer thickness limiting blade 27 is disposed on the upper front side of the development roller 25. The layer thickness limiting blade 27 is a plate-like member extending in the left and right direction and has a rectangular shape when viewed from the rear side. Further, the layer thickness limiting blade 27 is supported by the development frame 24 such that the lower edge of the layer thickness limiting blade 27 contacts the front edge part of the development roller 25.

In order to attach the process cartridge 15 to the body casing 2, the top cover 7 is disposed at the opened position, and the process cartridge 15 is attached to or detached from the body casing 2 via the cartridge opening 5.

In the state where the process cartridge 15 is attached to the body casing 2, the process cartridge 15 is disposed above the rear part of the paper supply unit 3, specifically, above the pickup roller 11 and the paper supply roller 12. In the state where the process cartridge 15 is attached to the body casing 2, the upper edge part of the drum front wall 92 is disposed at the front edge part of the process cartridge 15, the lower edge part of the drum front wall 92 is disposed at the lower edge part 91 of the process cartridge 15, the upper rear edge part of the charge support wall 94 is disposed at the upper edge part of the drum cartridge 18, and the rear edge part of the roller container wall 95 is disposed at the rear edge part of the drum cartridge 18. That is, the lower edge part 91 of the process cartridge 15 attached to the body casing 2 corresponds to the lower edge part of the drum front wall 92.

The lower edge part 91 of the process cartridge 15 faces the paper container space S1, and is disposed on a lower side with respect to the upper edge 90 of the paper opening 6.

The scanner unit 16 is disposed on the front side of the process cartridge 15 in the body casing 2, and is disposed on the upper side with respect to the paper opening 6. As indicated by a solid line in FIG. 1, the scanner unit 16 emits a laser beam based on image data toward the photosensitive drum 20 to expose the circumferential surface of the photosensitive drum 20.

The fixing unit 17 is disposed on the upper side of the rear part of the process cartridge 15 in the body casing 2. Further, the fixing unit 17 is disposed to overlap with the process cartridge 15 and the paper supply roller 12 when viewed in the up and down direction. That is, the process cartridge 15, the fixing unit 17 and the development roller 12 overlap with each other when viewed in the up and down direction.

The fixing unit 17 includes a heat roller 31 and a pressure roller 32. The pressure roller 32 is disposed on the upper rear side with respect to the heat roller 31, and the lower front edge of the pressure roller 32 contacts the upper rear edge of the heat roller 31.

2. Details of Body Casing

Figure 3:
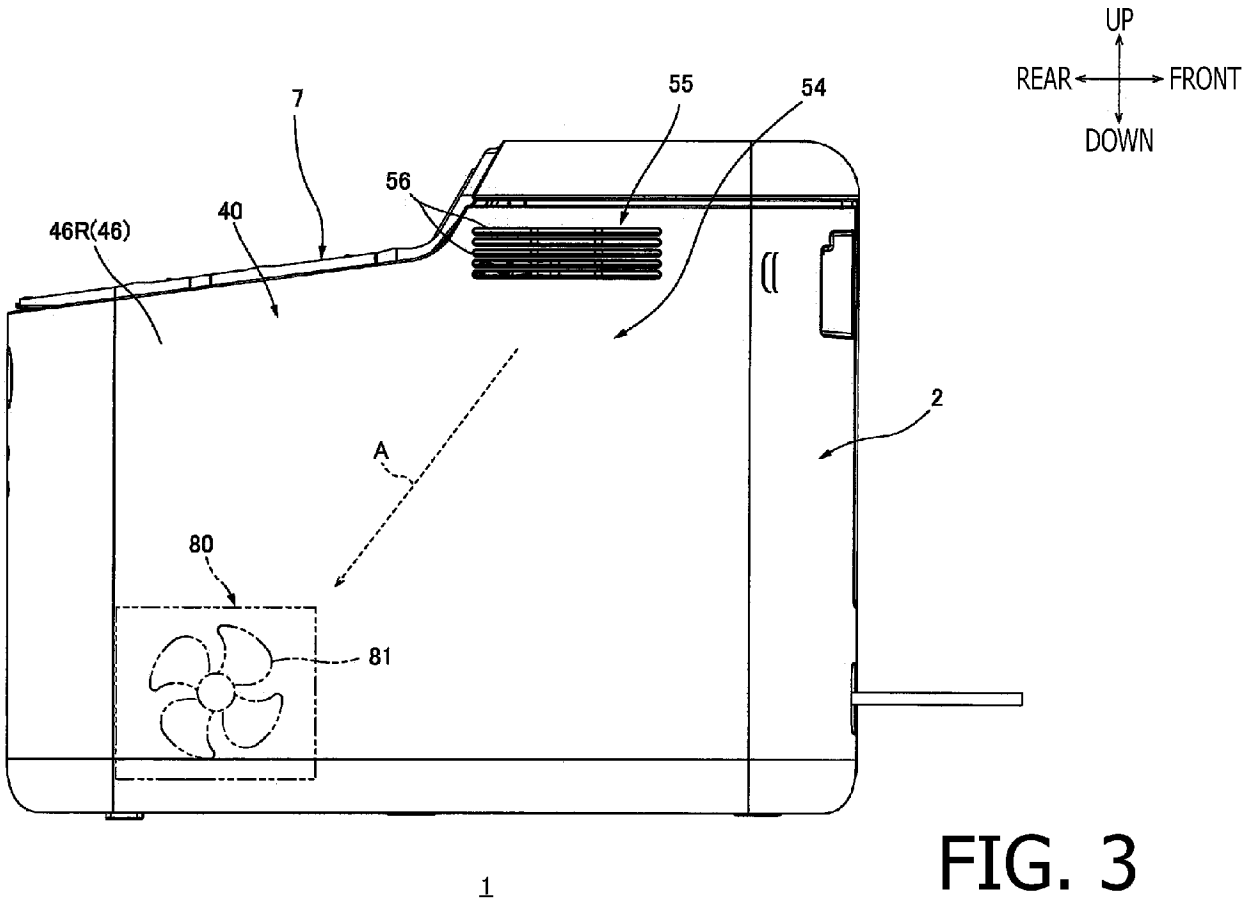
FIG. 3 is a right side view of the printer shown in FIG. 1.
Figure 5:
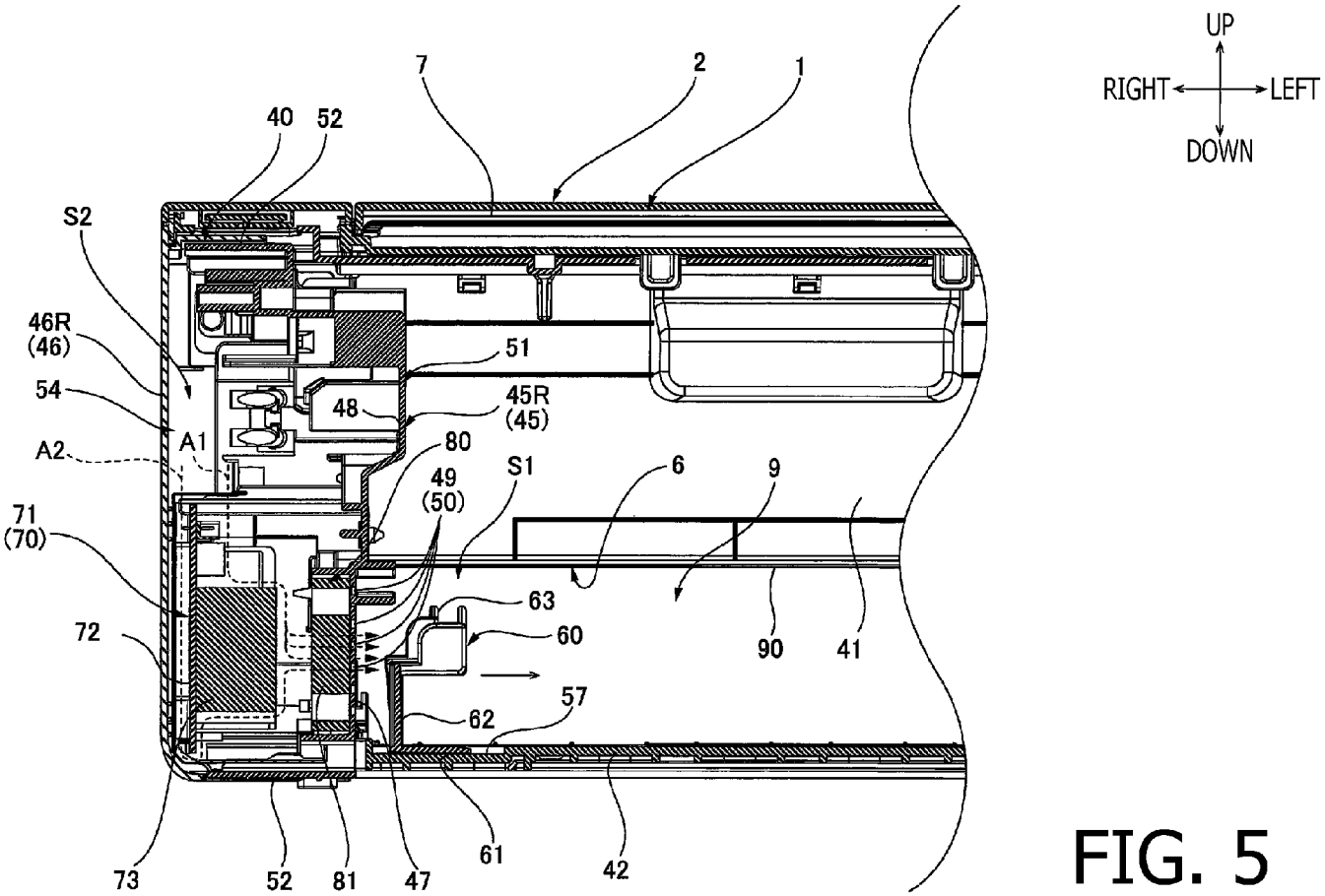
FIG. 5 is a cross section of the printer cut along a line C-C in FIG. 4.

As shown in FIGS. 1 and 2, the body casing 2 includes a pair of side walls 40, a front wall 41, a bottom wall 42 and a rear wall 43. The pair of side walls 40 is disposed at the left and right edges of the body casing 2 to have an interval therebetween. Each of the pair of side walls 40 has a rectangular shape when viewed as a side view as shown in FIG. 3, and includes a main frame 45 and a side cover 46 as shown in FIG. 5.

When the main frame 45 of the right side wall 40 is explained distinctively from the main frame 45 of the left side wall 40, the main frame 45 provided on the right side is referred to as a right main frame 45R and the main frame 45 provided on the left side is referred to as a left main frame 45L. Further, when the side cover 46 of the right side wall 40 is explained distinctively from the side cover 46 of the left side wall 40, the side cover 40 provided on the right side is referred to as a right side cover 46R, and the side cover 46 provided on the left side is referred to as a left side cover 46L.

The main frame 45 is provided in a space between the side walls 40 in the left and right direction. The main frame 45 is made of known resin, and has a box shape opened outward in the left and right direction. Further, the main frame 45 includes a plate 51 and a peripheral wall 52 which are formed integrally.

The plate 51 is a plate-like member having a rectangular shape when viewed as a side view, and includes a lower part 47 and an upper part 48. The lower part 47 is a lower part of the plate 51 with respect to a central part of the plate 51 in the up and down direction, and the upper part 48 is an upper part of the plate 51 with respect to the central part of the plate 51 in the up and down direction.

The peripheral wall 52 is formed to project outward from the peripheral edge of the plate 51 in the left and right direction. That is, each of the cross sections of the main frame 45 defined by cutting along the up and down direction and the front and rear direction is formed in a shape of a letter U.

As shown in FIGS. 4 and 5, the right main frame 45R has a communication opening 50. The communication opening 50 corresponds to a space for a fan 80 which is described later, and is disposed at the front edge part of the lower part 47 of the plate 51.

The communication opening 50 includes a plurality of holes 49. Each hole 49 has a circular shape when viewed as a side view, and penetrates the plate 51 in the left and right direction as shown in FIG. 5. Further, the plurality of holes 49 are disposed to have intervals therebetween in the radial direction of each hole 49.

As shown in FIG. 5, the side cover 46 is a side part of each side wall 40 in the left and right direction, and constitutes an exterior of each side wall 40. The side cover 46 covers the main frame 45 in the left and right direction from the outside. The side cover 46 is made of known resin, and, as shown in FIG. 2 the side cover 46 is a plate-like member having substantially the same size as that of the main frame 45. Further, both edge parts in the front and rear direction of the side cover 46 are formed to be bent inward in the left and right direction so as to cover the both edges in the front and rear direction of the main frame 45.

As a result, each side wall 40, i.e., the main frame 45 and the side cover 46, constitutes an enclosure 54 defining therein a container space S2.

The right side cover 46R has a ventilation hole 55 as shown in FIG. 3. The ventilation hole 55 is disposed at the rear part in the upper edge part of the right side cover 46R, and is disposed on the upper side with respect to the process cartridge 15 as shown in FIG. 1. Further, the ventilation hole 55 is aligned with the process cartridge 15 in the up and down direction when viewed in the left and right direction.

Further, the ventilation hole 55 includes a plurality of slits 56. Each slit 56 is formed in a linear shape extending in the front and rear direction when viewed as a side view, and penetrates the right side cover 46R in the left and right direction. The plurality of slits 56 are arranged in the up and down direction at constant intervals. The ventilation hole 55 (i.e., the plurality of slits 56) lets the container space S2 in the enclosure 54 communicate with the outside of the body casing 2.

The front wall 41 is a plate-like member having a rectangular shape extending in the left and right direction when viewed as a front view. Further, the front wall 41 is provided to extend between the upper part 48 of the plate 51 of the right main frame 45R and the upper part 48 of the plate 51 of the left main frame 45L.

The bottom wall 42 is disposed at the lower edge part of the body casing 2. The bottom wall 42 is a plate-like member having a rectangular shape when viewed as a bottom view. Further, the bottom wall 42 is provided to extend between the lower edge part of the plate 51 of the right main frame 45R and the lower edge part of the plate 51 of the left main frame 45L.

As shown in FIG. 5, the bottom wall 42 has restriction guide grooves 57. The restriction guide grooves 57 are provided respectively for a pair of paper restriction parts 60 and are disposed at both edge parts of the upper surface of the bottom wall 42 in the left and right direction. The restriction guide groove 57 has a rectangular shape extending in the front and rear direction when viewed as a plan view, and is formed to be recessed downward from the upper surface of the bottom wall 42.

The rear wall 43 is disposed at the rear edge part of the body casing 2. The rear wall 43 is a plate-like member formed in a rectangular shape when viewed as a rear view. The rear wall 43 is provided to extend between the rear edge part of the plate 51 of the right main frame 45R and the rear edge part of the plate 51 of the left main frame 45L.

As shown in FIG. 2, the lower edge of the front wall 41, the front edge of the lower part 47 of each plate 51 and the front edge of the bottom wall 42 define the paper opening 6. That is, the upper edge 90 of the paper opening 6 is the lower edge of the front wall 41.

The paper opening 6 is formed in a rectangular shape extending in the left and right direction when viewed as a side view, and an opening plane of the paper opening 6 is formed to extend in the up and down direction and in the left and right direction. Therefore, the opening plane of the paper opening 6 perpendicularly intersects with the feeding direction X which is described later. Further, the size of the paper opening 6 in the left and right direction is longer than the size in the left and right direction of the maximum size of the sheet of paper P which can be used for image formation in the printer 1.

The lower part 47, the bottom wall 42 and the lower edge part of the rear wall 43 of each plate 51 constitute the paper container 9. That is, the paper container 9 includes the bottom wall 42 and the lower parts 47 of the pair of plates 51. The paper container space S1 in the paper container 9 and the outside of the body casing 2 communicate with each other via the paper opening 6.

The paper container 9 includes the pair of paper restriction parts 60. As shown in FIGS. 2 and 5, the pair of paper restriction parts 60 is disposed on the upper surface of the bottom wall 42. The pair of paper restriction parts 60 is disposed to have an interval therebetween in the left and right direction. Each of the pair of paper restriction parts 60 includes a guide plate 61, a first restriction plate 62 and a second restriction plate 63 which are integrally provided.

As shown in FIG. 5, the guide plate 61 corresponds to the lower edge part of each paper restriction part 60, and is a plate-like member having a rectangular shape extending in the front and rear direction when viewed as a plan view. The size of the guide plate 61 in the left and right direction is shorter than the size of the restriction guide groove 57 in the left and right direction, and the size of the guide plate 61 in the front and rear direction is substantially equal to the size of the restriction guide groove 57 in the front and rear direction.

The first restriction plate 62 is configured to restrict movement of the sheet of paper P supported at the paper container 9 in the left and right direction. The first restriction plate 62 is formed to continuously extend upward from the outer edge parts of the guide plate 61 in the left and right direction. The size of the first restriction plate 62 in the up and down direction is shorter than the size of the lower part 47 of the plate 51 in the up and down direction, and the size of the first restriction plate 62 in the front and rear direction is substantially equal to the size of the guide plate 61 in the front and rear direction.

The second restriction plate 63 is configured to restrict the number of sheets of paper P supported at the paper container 9. As shown in FIG. 2, the second restriction plate 63 is a plate-like member having a shape of a letter L when viewed as a front view. The second restriction plate 63 extends continuously in the left and right direction from the front edge of the upper edge part of the first restriction plate 62 and is bent to extend upward. Further, as shown in FIG. 5, the upper edge part of the second restriction plate 63 is disposed at a position lower than the upper edge of the lower part 47 of the plate 51.

Since the guide plate 61 is disposed in the restriction guide groove 57, the paper restriction part 60 is supported by the bottom wall 42 to be slidable in the left and right direction. The pair of paper restriction parts 60 is formed to move in conjunction with each other by a link mechanism (not shown). Therefore, when one of the pair of paper restriction parts 60 slides inward in the left and right direction, the other of the paper restriction parts 60 also slides inward in the left and right direction. Further, when one of the paper restriction parts 60 slides outward in the left and right direction, the other of the pair of paper restriction parts 60 also slides outward in the left and right direction.

When the pair of paper restriction parts 60 are disposed to have the maximum interval therebetween in the left and right direction, the first restriction plate 62 of each paper restriction part 60 is disposed to have an interval on the inside in the left and right direction with respect to the lower part 47 of the corresponding plate 51, and the interval in the left and right direction of the first restriction plate 62 is substantially equal to the size in the left and right direction of the sheet of paper P for which the image formation can be executed in the printer 1.

As shown in FIGS. 2 and 4, the paper supply cover 8 is supported by the pair of side walls 40. As shown in FIG. 4, the paper supply cover 8 includes a rotation shaft 65 and a cover body 66.

The rotation shaft 65 has as a cylindrical shape extending in the left and right direction. The cover body 66 is a plate-like member, and is formed to extend, from the rotation shaft, outward in the radial direction of the rotation shaft 65. The both ends of the rotation shaft 65 protrude outward in the left and right direction from the cover body 66.

The paper supply cover 8 is supported by the body casing 2 such that the left and right ends of the rotation shaft 65 are rotatably supported by the lower front edge parts of the pair of main frames 45, respectively. As shown in FIG. 4, in the state where the paper supply cover 8 is disposed at the opened position, the upper surface of the cover body 66 and the upper surface of the bottom wall 42 are substantially in the same plane.

3. Details of Control Unit

As shown in FIG. 5, the printer 1 includes a control unit 70 and the fan 80. The control unit 70 and the fan 80 are disposed in the enclosure 54 of the right side wall 40 (i.e., in the container space S2). A motor and a gear train for inputting a driving force into the image formation unit 4 are disposed in the enclosure 54 of the left side wall 40 although these are not shown in the drawings.

The control unit 70 is configured to control operations of the image formation unit 4, and includes a low voltage power source board 71 and a control circuit board (not shown). The low voltage power source board 71 is disposed on the right side with respect to the fan 80, and is fixed to the right surface of the plate 51 of the right main frame 45R. That is, the low voltage power source board 71 is disposed on the opposite side of the paper container unit 9 with respect to the plate 51 of the right main frame 45R.

The low voltage power source board 71 includes a substrate main body 72 and a power source component 73. The substrate main body 72 is a plate-like member having a rectangular shape when viewed as a side view and extending in the front and rear direction. The substrate main body 72 is disposed on the right side with respect to the lower part 47 of the plate 51 to have an interval between the substrate main body 72 and the lower part 47, and is disposed on the left side with respect to the lower part of the right side cover 46R to have an interval between the substrate main body 72 and the lower part of the right side cover 46R. That is, the right side cover 46R is disposed on the opposite side of the plate 51 of the right mainframe 45R with respect to the substrate main body 72.

The substrate main body 72 is disposed on the upper side of the lower edge part of the peripheral wall 52 of the right main frame 45R to have an interval therebetween. The substrate main body 72 is electrically connected to the scorotron charger 22, the transfer roller 21, the development roller 25 and the supply roller 26 via wiring and electrodes (not shown). The power source component 73 is attached to the front edge part of the left surface of the substrate main body 72, and is disposed on the right side of the communication opening 50 to have an interval therebetween.

The control circuit board (not shown) is electrically connected to the low voltage power source board 71 via wiring, and is configured to control the low voltage power source board 71.

The fan 80 is disposed on the lower front part in the enclosure 54. Specifically, the fan 80 is attached to the right surface of the front edge part of the lower part 47 of the plate 51, to adjoin the communication opening 50 on the right side of the communication opening 50. As a result, the fan 80 is sandwiched between the low voltage power source board 71 and the lower part 47 of the plate 51, and faces the left surface of the substrate main body 72. That is, the low voltage power source board 71 is disposed on the opposite side of the plate 51 with respect to the fan 80. The power source component 73 is opposite the fan 80. The power source component 73, the fan 80 and the communication opening 50 overlap with each other when viewed along the left and right direction.

As shown in FIGS. 4 and 5, the fan 80 is disposed on the paper opening 6 side (the upstream side) in the feeding direction X in the lower part 47 of the right plate 51. As shown in FIG. 1, the fan 80 is disposed on the paper opening 6 side (i.e., on the front side) with respect to the paper supply roller 12 and the process cartridge 15. In other words, the paper supply roller 12 is disposed on the opposite side of the paper opening 6 with respect to the fan 80.

As shown in FIG. 5, the fan 80 is disposed on the right side of the right paper restriction part 60 to have an interval therebetween, and faces the right paper restriction part 60 via the communication opening 50.

The size of the fan 80 in the up and down direction is substantially equal to the size in the up and down direction of the lower part 47 of the plate 51. The upper edge of the fan 80 is higher than the upper edge of the right paper restriction part 60.

The fan 80 includes a rotating wing 81. The rotating wing 81 is rotatably provided with respect to the plate 51. By rotating, the rotating wing 81 causes air in the enclosure 54 to flow from the right side to the left side. Although not shown in the drawings, the fan 80 is electrically connected to the substrate main body 72 via wiring.

4. Sheet Storing Operation and Image Formation Operation (4-1) Sheet Storing Operation In the printer 1 configured as described above, a worker puts the sheet of paper P in the paper container 9 before the image formation operation as shown in FIG. 4. To put the sheet of paper P in the paper container 9, the worker moves the paper cover 8 to the opened position so as to open the paper opening 6 in the front and rear direction.

Then, the worker introduces the sheet of paper P into the paper container 9 along the feeding direction X pointing from the front side to the rear side via the paper opening 6. At this time, the first restriction plate 62 of the paper restriction part 60 restricts movement of the sheet of paper P in the left and right direction, and the second restriction plate 63 restricts the number of sheets of paper P introduced into the paper container 9.

As a result, the rear parts of the sheets of paper P are supported at the paper container 9, and are stacked on the upper surface of the bottom wall 42. Thus, a predetermined number of sheets of paper P is supported by the bottom wall 42 and the paper supply cover 8. In this case, the lower parts 47 of the pair of plates 51 are disposed to have an interval in the left and right direction with respect to the sheets of paper P supported by the bottom wall 42.

(4-2) Development Operation

Next, when the image formation operation is started under control of the control unit 70, the low voltage power source board 71 supplies power from the power source component 73 to the scorotron charger 22, the transfer roller 21, the development roller 25 and the supply roller 26. The motor (not shown) inputs the driving force to the various rollers (specifically, the photosensitive drum 20, the development roller 25, the supply roller 26, the agitator 30, the pickup roller 11, the paper supply roller 12 and the pressure roller 32) via the gear train.

Then, the scorotron charger 22 charges the surface of the photosensitive drum 20 uniformly. Thereafter, the scanner unit 16 exposes the surface of the photosensitive drum 20. As a result, an electrostatic latent image based on image data is formed on the surface of the photosensitive drum 20.

The agitator 30 agitates the toner in the toner reservoir 28, and supplies the agitated toner to the supply roller 26. The supply roller 26 supplies the toner supplied from the agitator 30 to the development roller 25. At this time, the toner is frictionally charged positively between the development roller 25 and the supply roller 26, and is held on the development roller 25. The layer thickness limiting blade 27 restricts the thickness of the toner held on the development roller 25 to a predetermined thickness.

The development roller 25 supplies, the toner which is held thereon to have a constant thickness, to the electrostatic latent image on the surface of the photosensitive drum 20. As a result, a toner image is held on the surface of the photo sensitive drum 20.

(4-3) Paper Supply Operation, Fixing Operation and Discharge Operation

The pickup roller 11 sends out the sheet of paper P supported at the paper container 9 toward the space between the paper supply roller 12 and the paper supply pad 13. The paper supply roller 12 handles, one by one, the sheet of paper P supplied to the space between the paper supply roller 12 and the paper supply pad 13. Then, the paper supply roller 12 conveys one by one the sheet of paper P to the rear side, and thereby the paper supply roller 12 conveys the sheet of paper P to the paper supply path 14 extending in the up and down direction. The sheet of paper P is supplied to the space between the photosensitive drum 20 and the transfer roller 21 at predetermined timing. That is, the paper supply roller 12 conveys the sheet of paper P supported at the paper container 9 to the process cartridge 15.

Next, when the sheet of paper P passes through the space between the photosensitive drum 20 and the transfer roller 21, the transfer roller 21 transfers the toner image on the photosensitive drum 20 to the sheet of paper P through a transfer bias.

Thereafter, the sheet of paper P is conveyed to the space between the heat roller 31 and the pressure roller 32. Then, the heat roller 31 and the pressure roller 32 heat and pressurize the sheet of paper P when the sheet of paper P passes through the space between the heat roller 31 and the pressure roller 32. At this time, the toner image on the sheet of paper P is thermally fixed on the sheet of paper P. Thereafter, the sheet of paper P is conveyed to the space between a pair of discharge rollers 36, and the pair of discharge rollers 36 discharges the sheet of paper P to the paper discharge tray 35 of the top cover 7.

Thus, the sheet of paper P is supplied from the paper container 9, passes through the space between the photosensitive drum 20 and the transfer roller 21, and then passes through the space between the heat roller 31 and the pressure roller 23. Then, the sheet of paper P is conveyed along a conveying path formed in a shape of a letter C when viewed as a side view so that the sheet of paper P is discharged to the paper discharge tray 35.

5. Cooling Operation

In the above described image formation operation, the power source component 73 supplies power to the scorotron charger 22, the transfer roller 21, the development roller 25 and the supply roller 26. Therefore, the power source component 73 may generate heat. The power source component 73 also supplies power to the fan 80 during the image formation operation. Therefore, the rotating wing 81 is continuously driven as shown in FIG. 5.

As a result, air around the fan 80 in the enclosure 54 is discharged into the paper container 9 via the communication opening 50. In this case, air in the enclosure 54 flows toward the fan 80, and the pressure in the enclosure 54 decreases. As a result, outside air is taken into the enclosure 54 via the ventilation hole 55 as shown in FIG. 3.

Consequently, an air current A from the ventilation hole 55 to the fan 80 is generated in the enclosure 54. That is, the air current A proceeds from the upper rear side to the lower front side.

As shown in FIG. 5, when the air current A reaches the low voltage power source board 71, the air current A branches into an air current Al passing through the left side of the substrate main body 72 and an air current A2 passing through the right side of the substrate main body 72.

After the air current Al passes through, toward the lower rear side, the space above the power source component 73 and between the substrate main body 72 and the plate 51, the air current Al reaches the power source component 73 and proceeds along the circumferential surface of the upper part of the power source component 73. Thereafter, the air current Al proceeds toward the fan 80.

After the air current A2 passes through the space between the substrate main body 72 and the side cover 46 toward the lower rear side, the air current A2 passes through the gap between the lower edge of the substrate main body 72 and the lower edge of the peripheral wall 52 while making a U-turn and then the air current A2 reaches the portion under the power source substrate 73. Then, the air current A2 proceeds along the circumferential surface of the lower part of the power source component 73, and thereafter proceeds to the fan 80. Although not shown in the drawings, the air current A1 and the air current A2 also pass through the front and rear sides of the power source component 73.

Then, the air current Al and the air current A2 join together, and flow into the paper container 9 via the communication opening 50 while being driven by the fan 80. That is, the fan 80 serves as an air discharging fan for discharging air to the paper container 9.

As a result, the low voltage power source board 71, namely the power source component 73, is cooled by the air current A (i.e., the air current A1 and the air current A2) during the image formation.

As shown in FIG. 2, the air current A which has flowed into the paper container 9 proceeds to the left side in the front edge part of the paper container space S1, and proceeds frontward to the paper opening 6 because the paper opening 6 is opened. Then, the air current A is discharged to the outside via the paper opening 6.

Thus, the cooling operation for the low voltage power source board 71 is completed.

6. Advantageous Effects (1) As shown in FIG. 4, in the printer 1, the paper container 9 supports the rear part of the sheet of paper P. That is, in the paper container 9, the paper container space S1 for supporting the sheet of paper P is secured. Further, as shown in FIG. 5, the fan 80 is disposed on the lower part 47 of the plate 51 defining the paper container 9.

Therefore, as shown in FIG. 4, a flowing path for the air being flowed by the fan 80 can be secured in the paper container space S1 in the paper container 9. As shown in FIGS. 4 and 5, the fan 80 is disposed on the side on which the paper opening 6 is provided in the feeding direction X, i.e., on the front edge part of the lower part 47 of the plate 51.

Therefore, the air in the paper container 9 can be smoothly discharged via the paper opening 6 through driving by the fan 80. As a result, even when an object is installed next to the printer 1, smooth flowing of air in the body casing 2 can be secured, and therefore heat in the printer 1 can be effectively radiated. Accordingly, the degree of freedom in regard to an installation position of the printer 1 can be enhanced.

(2) As shown in FIG. 5, the low voltage power source board 71 is supported by the plate 51 on which the fan 80 is disposed. Therefore, the fan 80 is disposed close to the power source component 73. As a result, by driving the fan 80, the air around the power source component 73 can be securely flowed, and thereby the power source component 73 can be cooled effectively.

(3) As shown in FIG. 1, the process cartridge 15, the fixing unit 17 and the paper supply roller 12 are disposed at positions which overlap with each other when viewed along the up and down direction. Therefore, the size of the printer 1 in the front and rear direction can be downsized in comparison with the case where the process cartridge 15, the fixing unit 17 and the paper supply roller 12 are aligned in the front and rear direction. As a result, the degree of freedom in regard to the installation position of the printer 1 can be enhanced.

Further, the process cartridge 15, the fixing unit 17 and the paper supply roller 12 are disposed on an opposite side (specifically on the rear side) of the paper opening 6 with respect to the fan 80. Therefore, the process cartridge 15, the fixing unit 17 and the paper supply roller 12 are disposed to have an interval with respect to the paper opening 6 in the front and rear direction.

As a result, it becomes possible to prevent air heated by heat generation of the power source component 73 from flowing toward the process cartridge 15, the fixing unit 17 and the paper supply roller 12 by driving of the fan 80, and thereby it becomes possible to prevent the process cartridge 15, the fixing unit 17 and the paper supply roller 12 from being heated.

The fan 80 is disposed on the front edge part of the lower part 47 of the plate 51, and discharges the air toward the paper container 9. Therefore, the air discharged to the paper container 9 by the fan 80 tends to be discharged to the outside of the paper container 9 via the paper opening 6 rather than flowing toward the side on which the process cartridge 15 is disposed. Therefore, it is securely prevented that the air heated by heat radiation of the power source component 73 heats the process cartridge 15, the fixing unit 17 and the paper supply roller 12.

(4) As shown in FIG. 1, the paper supply roller 12 is disposed on the lower side with respect to the upper edge 90 of the paper opening 6. Therefore, a relatively large space can be secured in the paper container 9 on a side on which the paper opening 6 is disposed with respect to the paper supply roller 12. As a result, by driving of the fan 80, the air in the paper container 9 can be discharged securely.

(5) As shown in FIG. 1, in the state where the process cartridge 15 is attached to the body casing 2, the lower edge part 91 of the process cartridge 15 is disposed on the lower side of the upper edge 90 of the paper opening 6.

Therefore, in the paper container 9, a relatively large space can be secured in the paper container 9 on a side on which the paper opening 6 is disposed with respect to the process cartridge 15, i.e., the paper supply roller 12. As a result, by driving of the fan 80, the air in the paper container 9 can be discharged more securely.

(6) As shown in FIG. 3, the body casing 2 has the ventilation hole 55. Therefore, when the fan 80 is driven, outside air flows into the enclosure 54 via the ventilation hole 55. As a result, the air current A can be generated between the ventilation hole 55 and the fan 80 in the enclosure 54.

As shown in FIG. 1, the ventilation hole 55 is disposed on the upper side with respect to the process cartridge 15 and is disposed to be aligned with the process cartridge 15 in the up and down direction when viewed along the left and right direction. That is, the ventilation hole 55 and the fan 80 are disposed to have a sufficient space therebetween along a direction connecting the lower front side and the upper rear side.

Therefore, as shown in FIG. 3, an adequate flowing space for the air current A generated between the ventilation hole 55 and the fan 80 can be secured, and thereby it becomes possible to let the air current A flow near the power source component 73. As a result, it becomes possible to cool the power source component 73 more effectively.

(7) As shown in FIG. 5, the power source component 73 and the fan 80 overlap with each other when viewed along the left and right direction. Therefore, by driving of the fan 80, it becomes possible to cause the air around the power source component 73 to flow more securely. As a result, the power source component 73 can be cooled more effectively.

(8) As shown in FIG. 5, the right main frame 45R and the right side cover 46R constitute the enclosure 54 which defines the container space S2. When the fan 80 is driven, the air current A is generated in the container space S2.

That is, the flowing path of air being caused to flow by the fan 80 can be secured on the paper container 90 side with respect to the fan 80 and on the both sides (left and right sides) of the low voltage power source board 71. That is, on the left side of the fan 80, the paper container space S1 is secured, and on the right side of the fan 80, the container space S2 is secured. Therefore, more smooth air flow can be secured in the body casing 2.

Since the fan 80 and the low voltage power source board 71 are accommodated in the container space S2, it is possible to cause the air current A generated by driving of the fan 80 to pass through a position near the power source component 73 more securely, and thereby it becomes possible to cool the power source component 73 more securely.

(9) As shown in FIG. 4, the pair of paper restriction parts 60 is able to restrict movement of the sheet of paper P in the left and right direction. Therefore, it is possible to prevent an image formed on the sheet of paper P from shifting in the left and right direction during the image formation operation.

As shown in FIG. 5, the fan 80 is disposed to face the right paper restriction part 60 to have an interval therebetween in the left and right direction. Therefore, it is possible to prevent the air current A generated by driving of the fan 80 from causing the sheet of paper P supported by the bottom wall 42 to flop, and thereby it becomes possible to support the sheet of paper P stably.

(10) As shown in FIG. 5, the upper edge of the lower part 47 of the plate 51 is disposed on the upper side with respect to the upper edge of the right paper restriction part 60. Therefore, as shown in FIG. 4, even when the sheet of paper P is accommodated in the paper container 9, the flowing path of the are being flowed by the fan 80 can be secured in the paper container 9.

As shown in FIG. 5, the upper edge of the fan 80 is disposed on the upper side with respect to the upper edge of the right paper restriction part 60. Therefore, it is possible to securely cause the air on the upper side of the sheet of paper P to flow.

(11) As shown in FIG. 4, in the state where the paper supply cover 8 is at the opened position, the paper supply cover 8 supports the front part of the sheet of paper P supported by the bottom wall 42. Therefore, the paper supply cover 8 and the bottom wall 42 are able to securely support the sheet of paper P.

7. Variation

In the above described embodiment, as shown in FIG. 5, the fan 80 causes air to flow from the right side toward the left side and thereby discharges the air toward the paper container 9. The embodiment is not limited to such a configuration. The fan 80 may cause the air to flow from the left side to the right side and suck the air from the paper container 9.

In this case, when the fan 80 is driven, the air disposed on the left side of the communication opening 50 flows toward the right side, and flows from the paper container 9 into the enclosure 54 via the communication opening 50. Then, the air disposed in the front end part of the paper container space S1 flows leftward to the fan 80. Accordingly, the outside air flows into the paper container 9 via the paper opening 6.

On the other hand, since the air flows from the paper container 9 into the enclosure 54, pressure in the enclosure 54 increases and thereby the air in the enclosure 54 is discharged to the outside through the ventilation hole 55.

Accordingly, in the enclosure 54, an air current flowing from the fan 80 to the ventilation hole 55 is generated. At this time, the air current proceeds from the lower front side to the upper rear side.

In the variation of the above described type, an air current is generated in the enclosure 54, and the air current passes through positions near the low voltage power source board 71 and the power source component 73. Therefore, the same advantageous effects as those of the above described embodiment can also be achieved.

What is claimed is:

1. An image forming apparatus, comprising:

an electric board on which an electric component is mounted;

a housing having an opening through which a recording medium passes, the housing comprising a container unit configured to support at least a part of the recording medium passed through the opening and a frame configured to support the electric board;

a feed roller configured to feed the recording medium supported in the container unit to an image formation unit; and a fan configured to cause air in the housing to flow, wherein the container unit comprises:

a stacker part configured to support at least the part of the recording medium; and a pair of side parts disposed to sandwich the stacker part between the pair of side parts, in an orthogonal direction which is perpendicular to a feeding direction of the feed roller, wherein the frame comprises at least one of the pair of side parts, the fan is disposed at one of the pair of side parts, at a position closer to the opening relative to the feed roller in the feeding direction and between the electric board and the frame in the orthogonal direction, the electric board is disposed, at one of the pair of side parts in which the fan is provided, on an opposite side with respect to the stacker part in the orthogonal direction, the electric board holds the electric component disposed on a side of the electric hoard facing the frame; and the electric component is opposite the fan.

2. The image forming apparatus according to claim 1, further comprising:

a process unit configured to form a developer image on the recording medium; and a fixing unit that is disposed on an upper side with respect to the process unit and is configured to fix the developer image on the recording medium, wherein:

the feed roller is disposed on a lower side with respect to the process unit;

the process unit, the fixing unit and the feed roller are disposed to overlap with each other when viewed along an up and down direction; and the fan is disposed at a position closer to the opening relative to the process unit in the feeding direction.

3. The image forming apparatus according to claim 2, wherein:

the housing comprises an edge part defining an upper edge of the opening; and at least a part of the feed roller is disposed at a position lower than the edge part of the housing.

4. The image forming apparatus according to claim 2, wherein:

the housing comprises an edge part defining an upper edge of the opening;

the process unit is configured to be detachably attachable to the housing; and in a state where the process unit is attached to the housing, at least a part of the process unit is disposed at a position lower than the edge part of the housing.

5. The image forming apparatus according to claim 2, wherein:

the housing has a ventilation hole through which an inside of the housing communicates with an outside of the housing; and the ventilation hole is disposed on an upper side with respect to the process unit and is disposed such that at least a part of the ventilation hole is aligned with the process unit in the up and down direction when viewed along the orthogonal direction.

6. The image forming apparatus according to claim 1, wherein:

the housing comprises a side cover disposed on an opposite side of the frame with respect to the electric board; and the frame and the side cover define a container space in which the fan and the electric board are contained.

7. The image forming apparatus according to claim 1, wherein:

the stacker part comprises a restriction part configured to restrict movement of the recording medium in the orthogonal direction; and the fan and the restriction part overlap with each other when viewed along the orthogonal direction.

8. The image forming apparatus according to claim 7, wherein:

at least a part of each of the pair of side parts is disposed on an upper side with respect to the restriction part; and at least a part of the fan is disposed on an upper side with respect to the restriction part.

9. The image forming apparatus according to claim 1, further comprising a cover configured to move between an opened position at which the opening is opened and a closed position at which the opening is closed, wherein the cover supports a part of the recording medium supported by the stacker part.

10. The image forming apparatus according to claim 1, wherein the fan comprises an air discharging fan configured to discharge air toward the stacker part.

* * * * *